US005981459A

United States Patent [19]

Verbiest et al.

[11] Patent Number: 5,981,459

[45] Date of Patent: Nov. 9, 1999

[54] FOAM FOR TREATING TEXTILE FABRICS

[75] Inventors: Jan Hendrik Maria Verbiest, Antwerpen; Jean Wevers, Steenhuffel, both of Belgium

[73] Assignee: The Procter & Gamble Company, Cincinnati, Ohio

[21] Appl. No.: 09/043,490

[22] PCT Filed: Sep. 27, 1996

[86] PCT No.: PCT/US96/15607

§ 371 Date: Jul. 27, 1998

§ 102(e) Date: Jul. 27, 1998

[87] PCT Pub. No.: WO97/12024

PCT Pub. Date: Apr. 3, 1997

[30] Foreign Application Priority Data

Sep. 29, 1995 [EP] European Pat. Off. ..... 95202619

[51] Int. Cl.[6] ..... C11D 3/08; C11D 3/12; C11D 17/04; D06M 11/77

[52] U.S. Cl. ..... 510/279; 510/334; 510/406; 510/418; 510/507; 510/515; 8/137

[58] Field of Search ..... 510/279, 334, 510/406, 418, 507, 515; 8/137

[56] References Cited

U.S. PATENT DOCUMENTS

| | | | |
|---|---|---|---|
| 3,650,956 | 3/1972 | Strand et al. | 510/396 |
| 4,563,186 | 1/1986 | Flynn et al. | 8/137 |
| 4,666,940 | 5/1987 | Bischoff et al. | 514/544 |
| 4,687,591 | 8/1987 | Castaldo | 510/256 |
| 4,761,240 | 8/1988 | Rothanavibhata et al. | 510/328 |
| 4,842,758 | 6/1989 | Crutzen | 510/321 |
| 4,844,821 | 7/1989 | Mermelstein et al. | 252/174.25 |
| 4,861,502 | 8/1989 | Caswell | 252/8.75 |
| 4,915,854 | 4/1990 | Mao et al. | 252/8.8 |
| 5,019,280 | 5/1991 | Caswell et al. | 252/8.8 |
| 5,821,203 | 10/1989 | Williamson | 510/102 |

FOREIGN PATENT DOCUMENTS

| | | | |
|---|---|---|---|
| 0 297 673 A2 | 1/1989 | European Pat. Off. | C11D 3/12 |
| 1456393 | 2/1989 | U.S.S.R. . | |

*Primary Examiner*—Lorna M. Douyon
*Attorney, Agent, or Firm*—D. Mitchell Goodrich; Kim William Zerby; Jacobus C. Rasser

[57] ABSTRACT

A foam for treating textile fabrics comprises a fabric softening clay. The foam may be dispensed from aerosol containers by means of a liquid or gaseous propellant. The packaged product comprises (i) a foaming detergent composition comprising fabric softening clay; (ii) a propellant; and (iii) a container having a dispensing means, wherein the foaming detergent composition and the propellant are packaged inside the container. A method of cleaning and conditioning textile fabrics is also provided.

9 Claims, No Drawings

FOAM FOR TREATING TEXTILE FABRICS

The invention relates to a foam for treating textile fabrics.

The preparation and use of foams for domestic fabric conditioning, in particular for fabric conditioning in a drying machine is known.

U.S. Pat. No. 242 377, issued Dec. 30th, 1980, describes foaming compositions comprising conditioning agents such as cationic surfactants. It is disclosed that fabrics are washed in a conventional laundry process, and that the freshly washed fabrics are then put into a dryer with the conditioning foam. In this way the anionic surfactants used in the washing process, and the cationic surfactants used in the foam conditioning cycle, do not interact or complex with each other.

The aim of the present invention is to provide foam which both cleans and conditions the fabric in a single process (i.e. Softening-through-the-wash benefits).

A further aim of the invention is to improve the stability of a foam.

These objectives are achieved by fully or partly replacing cationic surfactant in the prior art composition by clay, thereby realising softness benefits whilst avoiding the problem of undesirable cationic/anionic complexing. Furthermore, it is surprising that clay improves foam stability. According to J. J. Bikerman "Foams", Springer-Verlag New York Inc., 1973, clay gives poor foam stability (bentonite on page 155, line 12) and colloidal clays (paragraph spanning pages 251 and 252). Improved foam stability in turn means that less propellant is required in order to generate light (i.e. low density) foams.

SUMMARY OF THE INVENTION

The invention concerns a foam for treating textile fabrics, the foam comprising a fabric softening clay. It is preferred that the foam comprises from 0.1% to 20% by weight of fabric softening clay, and the clay is preferably selected from the group consisting of montmorillonite, saponite, hectorite or mixtures thereof.

In a further aspect of the invention the foam may be dispensed from aerosol containers by means of a liquid or gaseous propellant. Carbon dioxide gas is most preferred as propellant. In this aspect of the invention a packaged product is provided comprising:

(i) a foaming detergent composition comprising fabric softening clay;

(ii) a propellant; and (iii) a container having a dispensing means, wherein the foaming detergent composition and the propellant are packaged inside the container.

In a still further aspect of the invention a method of cleaning and conditioning textile fabrics is provided comprising the steps of either applying a clay-containing foam to the textile fabric and subsequently removing foam residues, preferably by rinsing or by vacuum; or, alternatively dissolving a clay-containing foam to form an aqueous solution and immersing the textile fabric in the aqueous solution.

The methods of the invention may be carried out by hand, or in a washing machine.

DETAILED DESCRIPTION OF THE INVENTION

Foam is a coarse dispersion of gas in a relatively small amount of liquid. The foams of the present invention are a continuous liquid phase comprising a composition, and a dispersed phase comprising a gas. Typically, the gas "bubbles" of the dispersed phase can vary in size from 50 micrometers to several millimetres.

In general, the quality of the foam is determined by assessing various foam quality attributes, such as: 1) the appearance of the foam as it is determined by the uniformity of the bubble size distribution, as well as by the actual bubble sizes, wherein small and uniformly sized bubbles are generally preferred; 2) the thickness of the foam as it is determined by the apparent foam viscosity, wherein a greater apparent foam viscosity is generally preferred; 3) the density of the foam which is preferably less than 250 g/l, more preferably less than 150 g/l, and most preferably less than 100 g/l; and 4) the drainage of the liquid from the foam upon standing on a solid surface, wherein slow drainage of the liquid is generally preferred.

Preferred components of the detergent foam will now be described in more detail.

Water-soluble salts of the higher fatty acids, i.e., "soaps", are useful anionic surfactants in the compositions herein. This includes alkali metal soaps such as the sodium, potassium, ethanolamine, ammonium, and alkylammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the ethanolamine, sodium and potassium salts of the mixtures of fatty acids derived from coconut oil and tallow, i.e., monoethanolamine, sodium or potassium tallow and coconut soap.

Useful anionic surfactants also include the water-soluble salts, preferably the alkali metal, ethanolamine, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the alkyl sulfates, especially those obtained by sulfating the higher alcohols ($C_8$–$C_{18}$ carbon atoms) such as those produced by reducing the glycerides of tallow or coconut oil; and the alkyl benzene sulfonates in which the alkyl group contains from about 9 to about 15 carbon atoms, in straight or branched chain configuration, e.g., those of the type described in U.S. Pat. Nos. 2,220,099 and 2,477,383; and methyl ester sulphonates. Especially valuable are linear straight chain alkyl benzene sulfonates in which the average number of carbon atoms in the alkyl group is from about 11 to 13, abbreviated as $C_{11}$–$C_{13}$ LAS.

Other anionic surfactants herein are the alkyl glyceryl ether sulfonates, especially those ethers of higher alcohols derived from tallow and coconut oil; coconut oil fatty acid monoglyceride sulfonates and sulfates; salts of alkyl phenol ethylene oxide ether sulfates containing from about 1 to about 10 units of ethylene oxide per molecule and wherein the alkyl groups contain from about 8 to about 12 carbon atoms; and salts of alkyl ethylene oxide ether sulfates containing from about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; watersoluble salts of olefin sulfonates containing from about 12 to 24 carbon atoms; and beta-alkyloxy alkane sulfonates containing from about 1 to 3 carbon atoms in the alkyl group and from about 8 to about 20 carbon atoms in the alkane moiety.

Anionic surfactants are preferably used at levels of from 5% to 50%, preferably from 10% to 40%, more preferably from 18% to 30% by weight of the foaming composition.

Water-soluble nonionic surfactants may be used, but are less preferred in the clay-containing compositions of the invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 16 carbon atoms, in either a straight chain or branched chain configuration, with from about 1 to 25 moles, preferably from about 2 to 7 moles of ethylene oxide per mole of alkyl phenol.

Preferred nonionics are the water-soluble condensation products of aliphatic alcohols containing from 8 to 22 carbon atoms, in either straight chain or branched configuration, with from 1 to 25 moles of ethylene oxide per mole of alcohol, especially 2 to 7 moles of ethylene oxide per mole of alcohol. Particularly preferred are the condensation products of alcohols having an alkyl group containing from about 9 to 15 carbon atoms; and condensation products of propylene glycol with ethylene oxide.

Other preferred nonionics are polyhydroxy fatty acid amides which may be prepared by reacting a fatty acid ester and an N-alkyl polyhydroxy amine. The preferred amine for use in the present invention is N—(R1)—CH2(CH2OH)4—CH2—OH and the preferred ester is a C12–C20 fatty acid methyl ester. Most preferred is the reaction product of N-methyl glucamine (which may be derived from glucose) with C12–C20 fatty acid methyl ester.

Methods of manufacturing polyhydroxy fatty acid amides have been described in WO 9206073, published on Apr., 16th 1992. This application describes the preparation of polyhydroxy fatty acid amides in the presence of solvents. In a highly preferred embodiment of the invention N-methyl glucamine is reacted with a C12–C20 methyl ester.

Semi-polar nonionic surfactants include water-soluble amine oxides containing one alkyl moiety of from about 10 to 18 carbon atoms and 2 moieties selected from the group consisting of alkyl groups and hydroxyalkyl groups containing from 1 to about 3 carbon atoms; water-soluble phosphine oxides containing one alkyl moiety of about 10 to 18 carbon atoms and 2 moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be either straight or branched chain and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium phosphonium, and sulfonium compounds in which one of the aliphatic substituents contains from about 8 to 18 carbon atoms.

Useful cationic surfactants include water-soluble quaternary ammonium compounds of the form $R_4R_5R_6R_7N^+X^-$, wherein $R_4$ is alkyl having from 10 to 20, preferably from 12–18 carbon atoms, and $R_5$, $R_6$ and $R_7$ are each $C_1$ to $C_7$ alkyl preferably methyl; $X^-$ is an anion, e.g. chloride. Examples of such trimethyl ammonium compounds include $C_{12-14}$ alkyl trimethyl ammonium chloride and cocalkyl trimethyl ammonium methosulfate.

Other surfactants that may be used in the compositions of the present invention include C10–C18 glycerol ethers, C10–18 alkyl polyglycoside and their corresponding sulphated polyglycosides, alkyl ester sulphonates, and oleoyl sarcosinate.

The foam of the present invention can contain neutral or alkaline salts which have a pH in solution of seven or greater, and can be either organic or inorganic in nature. While some of the salts are inert, many of them also function as detergency builder materials in the laundering solution.

Examples of neutral water-soluble salts include the alkali metal, ethanolamine, ammonium or substituted ammonium chlorides, fluorides and sulfates. The sodium, ethanolamine and ammonium salts of the above are preferred. Citric acid and, in general, any other organic or inorganic acid may be incorporated into the present invention.

Other useful water-soluble salts include the compounds commonly known as detergent builder materials. Builders are generally selected from the various water-soluble, alkali metal, ethanolamine, ammonium or substituted ammonium phosphates, polyphosphates, phosphonates, polyphosphonates, carbonates, silicates, borates, and polyhydroxysulfonates. Preferred are the sodium, ethanolamine and ammonium salts of the above.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the salts of ethylene diphosphonic acid, the salts of ethane 1-hydroxy-1,1-diphosphonic acid and the salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, incorporated herein by reference. In general, however, phosphates are preferably avoided for environmental reasons.

Examples of nonphosphorus, inorganic builders are sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4.

An essential feature of the present invention is fabric softening clay.

Fabric softening clays may be either unmodified or organically modified. Those clays which are not organically modified can be described as expandable, three-layered clays, i.e., aluminosilicates and magnesium silicates, having an ion exchange capacity of at least 50 meq/100 g. of clay and preferably at least 60 meq/100 g. of clay. The starting clays for the organically modified clays can be similarly described. The term "expandable" as used to describe clays relates to the ability of the layered clay structure to be swollen, or expanded, on contact with water. The three-layer expandable clays used herein are those materials classified geologically as smectites. There are two distinct classes of smectite-type clays that can be broadly differentiated on the basis of the numbers of octahedral metal-oxygen arrangements in the central layer for a given number of silicon-oxygen atoms in outer layers. A more complete description of clay minerals is given in "Clay Colloid Chemistry" by H. van Olphen, John Wiley & Sons (Interscience Publishers), New York, 1963. Chapter 6, especially pages 66–69.

The family of smectite (or montmorillonoid) clays includes the following trioctahedral minerals: talc; hectorite; saponite; sauconite; vermiculite; and the following dioctahedral minerals: prophyllite; montmorillonite; volchonskoite and nontronite.

The clays employed in these compositions contain cationic counterions such as protons, sodium ions, potassium ions, calcium ions, and lithium ions. It is customary to distinguish between clays on the basis of one cation predominantly or exclusively absorbed. For example, a sodium clay is one in which the absorbed cation is predominantly sodium. Such absorbed cations can become involved in exchange reactions with cations present in aqueous solutions. A typical exchange reaction involving a smectite-type clay is expressed by the following equation:

$$\text{smectite clay } (Na)^+ + NH_4OH \Rightarrow \text{smectite clay } (NH_4)^+ + NaOH.$$

Since in the foregoing equilibrium reaction, an equivalent weight of ammonium ion replaces an equivalent weight of sodium, it is customary to measure cation exchange capacity (sometimes termed "base exchange capacity") in terms of milliequivalents per 100 g. of clay (meq/100 g). The cation exchange capacity of clays can be measured in several ways, including by electrodialysis, by exchange with ammonium ion followed by titration, or by a methylene blue procedure, all as fully set forth in Grimshaw, "The Chemistry and Physics of Clays", pp. 264–265, Interscience (1971). The cation exchange capacity of a clay material relates to such factors as the expandable properties of the clay, the charge of the clay (which in turn is determined at least in part by the lattice structure), and the like. The ion exchange capacity of clays varies widely in the range form about 2 meq/100 g. of kaolinites to about 150 meq/100 g., and greater, for certain smectite clays.

Preferred smectite-type clays are sodium montmorillonite, potassium montmorillonite, sodium hectorite and potassium hectorite. The clays used herein have a particle size range of up to about 0.05 mm.

Any of the clays used herein may be either naturally or synthetically derived.

Other Ingredients

Other preferred ingredients include (but are not limited to) enzymes, polymers.

Enzymes

Enzymes can be included in the formulations herein for a wide variety of fabric laundering purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Ser. No. 87303761.8, filed Apr. 28, 1987, and European Patent Application 130,756, Bott et al, published Jan. 9, 1985).

Amylases include, for example, α-amylases described in British Patent Specification No. 1,296,839 (Novo), RAPIDASE, International Bio-Synthetics, Inc. and TERMAMYL, Novo Industries.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). suitable cellulases are also disclosed in GB-A-2.075.028; GB-A-2.095.275 and DE-OS-2.247.832. CAREZYME (Novo) is especially useful.

Suitable lipase enzymes for detergent usage include those produced by microorganisms of the Pseudomonas group, such as Pseudomonas stutzeri ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex Chromobacter viscosum, e.g. Chromobacter viscosum var. lipolyticum NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex Pseudomonas gladioli. The LIPOLASE enzyme derived from Humicola lanuginosa and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Enzyme Stabilizers

The enzymes employed herein are stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.) Additional stability can be provided by the presence of various other art-disclosed stabilizers, especially borate species: see Severson, U.S. Pat. No. 4,537,706. Typical detergents, especially liquids, will comprise from about 1 to about 30, preferably from about 2 to about 20, more preferably from about 5 to about 15, and most preferably from about 8 to about 12, millimoles of calcium ion per liter of finished composition. This can vary somewhat, depending on the amount of enzyme present and its response to the calcium or magnesium ions. The level of calcium or magnesium ions should be selected so that there is always some minimum level available for the enzyme, after allowing for complexation with builders, fatty acids, etc., in the composition. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. A small amount of calcium ion, generally from about 0.05 to about 0.4 millimoles per liter, is often also present in the composition due to calcium in the enzyme slurry and formula water. In solid detergent compositions the formulation may include a sufficient quantity of a water-soluble calcium ion source to provide such amounts in the laundry liquor. In the altemative, natural water hardness may suffice.

It is to be understood that the foregoing levels of calcium and/or magnesium ions are sufficient to provide enzyme stability. More calcium and/or magnesium ions can be added to the compositions to provide an additional measure of grease removal performance. Accordingly, as a general proposition the compositions herein will typically comprise from about 0.05% to about 2% by weight of a water-soluble source of calcium or magnesium ions, or both. The amount can vary, of course, with the amount and type of enzyme employed in the composition.

The compositions herein may also optionally, but preferably, contain various additional stabilizers, especially borate-type stabilizers. Typically, such stabilizers will be used at levels in the compositions from about 0.25% to about 10%, preferably from about 0.5% to about 5%, more preferably from about 0.75% to about 3%, by weight of boric acid or other borate compound capable of forming boric acid in the composition (calculated on the basis of boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

Dye Transfer Inhibiting Agents

The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: R-$A_x$-P; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

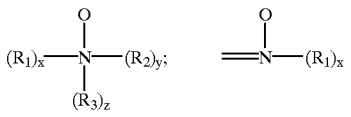

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the detergent compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis*, Vol 113. "Modem Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions also may employ a polyvinyl-pyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

Foam stabilising agents, apart from the fabric softening clay, may also be employed in the compositions of the present invention. Especially preferred are alyphatic alcohols such as straight chain saturated alcohols of 12 to 18 carbon atoms e.g. cetyl alcohol, stearyl alcohol, myristyl alcohol and mixtures thereof. Polymers including polyvinylpyrrolidone, polyvinyl alcohol, polyacrylamide, polypeptides, polysaccharides, cellulose derivatives; and also natural and synthetic gums and resins such as guar gum, carageenan, sodium alginate and caseinate may also be used in the present invention.

Textile fabrics, as defined herein, are any materials made from cloth, including garments such as shirts, blouses, socks, skirts, trousers, jackets, underwear etc, and also including tablecloths, towels, curtains etc. The definition of textile fabrics as used herein does not include carpets and similar floor coverings.

Textile fabrics which are to be us ed in the present invention are commonly made by weaving or knitting. Many different fibres may be used to produce woven, knitted or other types of textile fabric including synthetic fibres (such as polyester, polyamide, etc.) and natural fibres from plants (such as cotton, hemp) and from animals (such as wool, angora, silk). Blends of different fibres are also commonly used.

It is important to distinguish between the foam of the present invention and the suds which are commonly encountered in everyday washing process. The foam of the present invention is much more concentrated and comprises less water than conventional suds. The foam of the present invention preferably comprises at least 18% by weight, and preferably at least 25% by weight of a surface active agent. Most preferred foams for use as cleaning compositions comprise at least 10% by weight, preferably at least 20% by weight of anionic surfactant.

On the other hand, suds, which are formed in conventional washing process when detergents are diluted prior to washing, are formed from quite dilute solutions typically 100 g of product in 10 litres of water. The result is a wash liquor which comprises about 99% by weight of water. A layer of suds may form on the surface of the wash liquor, the composition of the suds being similar to that of the wash liquor itself. The surfactant content of the suds will normally be much less than 1%, typically less than 0.3%. Consequently the difference between the foam of the present invention and the suds of a conventional washing process will be understood.

It will also be recognised by the man skilled in the art that suds are often considered undesirable in the washing process and antisuds agents are often employed to reduce or control them. In a washing process in which the solution of detergent active agents is the medium of transport of the actives to the fibre surface, the presence of suds can diminish washing performance. This is because the detergent actives which are in the suds are no longer dissolved in the washing liquor itself, and are not therefore efficiently transported to the fibre surface.

Packaged Product

The packaged product of the present invention comprises a sealed container, such as an essentially cylindrical bottle, having a dispensing means such as a nozzle. The container contains the composition and propellant gas. Suitable containers may be made from any material, especially aluminium, tin-plate, plastics including PET, OPP, PE or polyamide and including mixtures, laminates or other combinations of these. Foam is dispensed when the nozzle is activated and the detergent is released together with the propellant gas. The propellant gas expands to form many "bubbles" within the composition thereby creating the foam.

Propellant

The propellant of this aspect of the present invention comprises carbon dioxide, or nitrous oxide (especially N2O), fluorocarbons (e.g. CFC, HCFC and HFC), alkanes (e.g. propane, butane, pentane, hexane), nitrogen, air or mixtures thereof. Most preferred is carbon dioxide.

Various ways to pressurise the propellant gas are known in the art. For example the gas may be pressurised at the time of packing. The product may be physically separated from a compressed gas by a membrane such as rubber under tension. Alternatively a means for pressurising the gas subsequently by mechanical action may be provided (so-called "pump and spray" systems).

Various apparatus for delivering foams are described in U.S. Pat. No. 5,364,031 issued on Nov. 15th 1994 entitled "Foam Dispensing Nozzles and Dispensers Employing Said Nozzles".

Any nozzle or nozzle/valve assembly which provides a means for releasing the mixture of detergent ingredients from the container and provides a foam is suitable for use in the present invention. The Precision Valve Company (Valve Précision in France) supplies a range of nozzle assemblies for various applications including shaving foams and carpet cleaners under various trade names including City®, Montego®, Power Jet®, Vulcan® and Visco®. Nozzles which disperse the foam both horizontally and vertically (when the container is held upright) are available. Metering nozzles which dispense a predetermined amount of foam are also available and useful in the present invention. Metering valves are disclosed in WO9108965 (Precision Valve Co) and EP-A 616953 (3M Co). In order for the apparatus to be effective in the method of the present invention it should deliver the foam at a rate of at least 3 g per second of foam from the sealed container, more preferably at a rate of at least 10 g per second.

EXAMPLE

The following compositions were prepared:

| | Ex. 1 | Comparative Example |
|---|---|---|
| Sodium alkyl sulphate | 13.4 | 13.4 |
| Sodium alkyl ethoxy (3) sulphate | 2.5 | 2.5 |
| Polyhydroxy fatty acid (C12–C14) amide | 4.0 | 4.0 |
| Alkyl dimethyl hydroxyethyl ammonium chloride | 1.5 | 1.5 |
| Sodium soap | 18.2 | 18.2 |
| Sodium citrate | 2.0 | 2.0 |
| Phosphonic acid | 1.5 | 1.5 |
| Propane 1,2 diol | 8.5 | 8.5 |
| Ethanol | 3.7 | 3.7 |
| Smectite clay | 3.4 | — |
| Water | 32.6 | 36 |
| Miscellaneous minors | 8.7 | 8.7 |

Both compositions were packed into a conventional aerosol container which was then pressurised up to 10 bar with carbon dioxide propellane. Both containers were sealed with standard valves and foaming nozzles. The comparative example was found to generate a foam which rapidly collapsed. The product of example 1 however produced a much more stable foam.

What is claimed is:

1. A foam for treating textile fabrics wherein the foam comprises:

(a) from 0.1% to 20% by weight of a fabric softening clay;

(b) a foam stabilizing agent; and (c) from 18% to 30% by weight of anionic surfactant;

wherein the composition contains no cationic surfactants.

2. A foam according to claim 1 the fabric softening clay being selected from the group consisting of montmorillonite, saponite, hectorite and mixtures thereof.

3. A packaged product comprising:

(i) a foaming detergent composition;

(ii) a propellant; and (iii) a container having a dispensing means;

wherein the foaming detergent composition and the propellant are packaged inside the container, and the foaming detergent composition comprises:

(a) from 0.1% to 20% by weight of fabric softening clay;

(b) a foam stabilizing agent; and (c) from 18% to 30% by weight of anionic surfactant;

wherein the composition contains no cationic surfactants.

4. A packaged product according to claim 3, the fabric softening clay being selected from the group consisting of montmorillonite, saponite, hectorite and mixtures thereof.

5. A packaged product according to claim 3 wherein the propellant is carbon dioxide.

6. A method of cleaning and conditioning textile fabrics comprising the steps of:

(i) applying a foam according to claim 1 to the textile fabric and (ii) subsequently removing foam residues by vacuum.

7. A method of cleaning and conditioning textile fabrics comprising the steps of:

(i) applying a foam according to claim 1 to the textile fabric and (ii) subsequently removing foam residues by rinsing.

8. A method of cleaning and conditioning textile fabrics comprising the steps of:

(i) dissolving a foam according to claim 1 to form an aqueous solution and (ii) immersing the textile fabric in the aqueous solution.

9. A method according to claim 8, carried out in a washing machine.

* * * * *